US008408536B2

(12) United States Patent
Liu et al.

(10) Patent No.: US 8,408,536 B2
(45) Date of Patent: Apr. 2, 2013

(54) SHEET FEEDING APPARATUS

(75) Inventors: Pan-Chih Liu, New Taipei (TW); Liang-Ching Su, New Taipei (TW)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 0 days.

(21) Appl. No.: 13/278,134

(22) Filed: Oct. 20, 2011

(65) Prior Publication Data

US 2013/0001865 A1 Jan. 3, 2013

(30) Foreign Application Priority Data

Jun. 30, 2011 (TW) ..... 100123070

(51) Int. Cl.
*B65H 3/34* (2006.01)
*B65H 1/00* (2006.01)

(52) U.S. Cl. ..... 271/167; 271/162

(58) Field of Classification Search ..... 271/121, 271/167, 162, 145
See application file for complete search history.

(56) References Cited

U.S. PATENT DOCUMENTS

| | | | | |
|---|---|---|---|---|
| 6,227,535 | B1 * | 5/2001 | Bae | 271/121 |
| 7,651,082 | B2 * | 1/2010 | Hendrix et al. | 271/121 |
| 7,798,485 | B2 * | 9/2010 | Tu et al. | 271/125 |
| 7,980,554 | B2 * | 7/2011 | Eltzroth et al. | 271/167 |
| 2004/0251592 | A1 * | 12/2004 | Ruhe et al. | 271/109 |
| 2004/0251602 | A1 * | 12/2004 | Ruhe et al. | 271/167 |
| 2006/0113721 | A1 * | 6/2006 | Kim | 271/121 |
| 2008/0150220 | A1 * | 6/2008 | Eltzroth et al. | 271/167 |

* cited by examiner

*Primary Examiner* — Patrick Cicchino
(74) *Attorney, Agent, or Firm* — Altis Law Group, Inc.

(57) ABSTRACT

A sheet feeding apparatus includes a tray, a driving mechanism disposed above the tray, a separating mechanism rotatably connected to the tray, and at least one resilient element to provide a constant pressure against the separating mechanism. The driving mechanism includes at least one roller to move one of the sheets. The separating mechanism includes at least one retard pad to separate the sheets and create frictional resistance between the separating mechanism and the stack of the sheets. When the tray has only a few sheets left, the separating mechanism is rotated and the frictional resistance is reduced.

4 Claims, 7 Drawing Sheets

SHEET FEEDING APPARATUS

BACKGROUND

1. Technical Field

The present disclosure relates to paper feeding apparatus, and particularly to a paper feeding apparatus capable of reducing the torsion force on the motor.

2. Description of Related Art

Sheet processing apparatus such as scanners and printers may include a tray for holding a stack of sheets, and a roller connected to a motor for driving the sheets to a processing portion. Traditionally, a retard pad with a frictional surface contacting the lower surface of the stack of sheets is designed for holding the bottom sheet in the stack to minimize multi-sheet pickups of the last few sheets, such that the roller can move one sheet each time. However, the retard pad imposes an excessively high torsion load on the motor, which may frequently cause errors in the sheet processing apparatus.

BRIEF DESCRIPTION OF THE DRAWINGS

Many aspects of the embodiments can be better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the several views.

DETAILED DESCRIPTION

Figure 1:
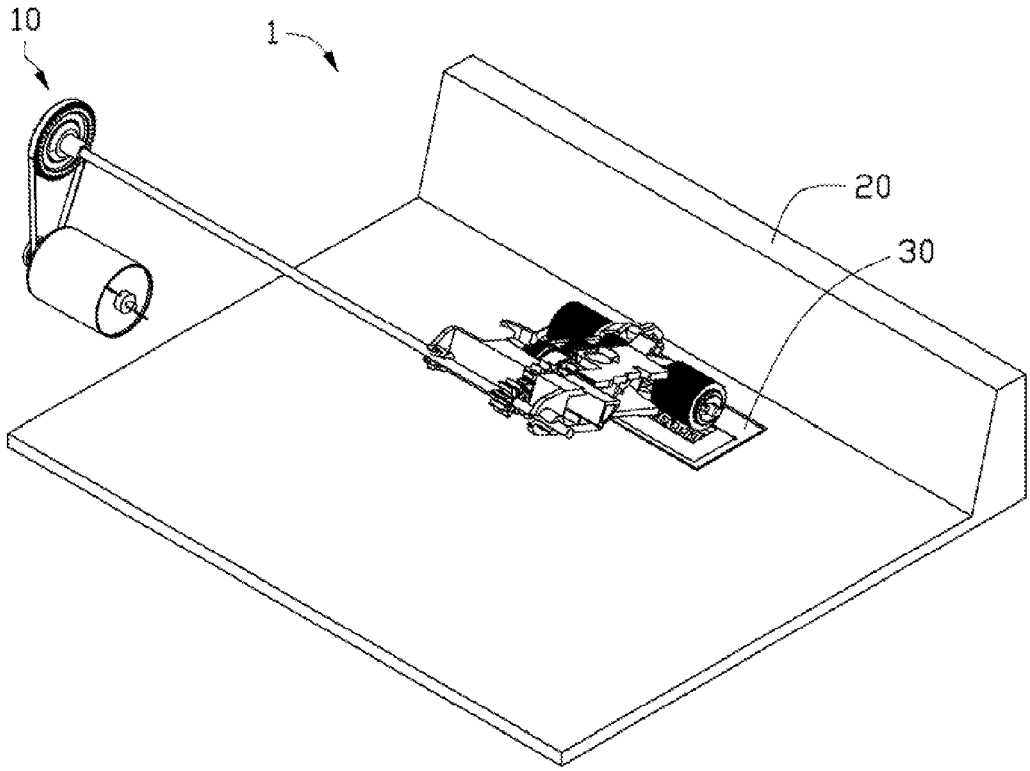
FIG. 1 is an isometric view of a sheet feeding apparatus according to an exemplary embodiment.

Embodiments of the present disclosure are now described, with reference to the accompanying drawings.

Referring to FIGS. 1-4, a sheet feeding apparatus 1 according to an exemplary embodiment is illustrated. The sheet feeding apparatus 1 includes a tray 20 for holding a stack of paper sheets 2, a driving assembly 10 disposed above the tray 20, a separating mechanism 30 rotatably connected to the tray 20, and two resilient elements 40 to provide a spring force to the separating mechanism 30. In the embodiment, the resilient elements 40 are torsion springs.

The driving assembly 10 includes a motor 11, a shaft 12, a transmission mechanism 14, and two first rollers 13 mounted on the transmission mechanism 14. The motor 11 is connected to a power source (not shown), and the shaft 12 and the transmission mechanism 14 are connected between the motor 11 and the rollers 13. When the motor 11 works, the shaft 12 and the transmission mechanism 14 transmits the rotation from the motor 11 to the first rollers 13. The rollers 13 then rotate against the sheet 2. As the depth of the stack of sheets 2 decreases, the separating mechanism 30 rotates relative to the tray 20 and then reduces frictional resistance to the sheets 2. Thus, the geometric arrangement of the components reduces the torsion force on the motor 11.

Figure 2:
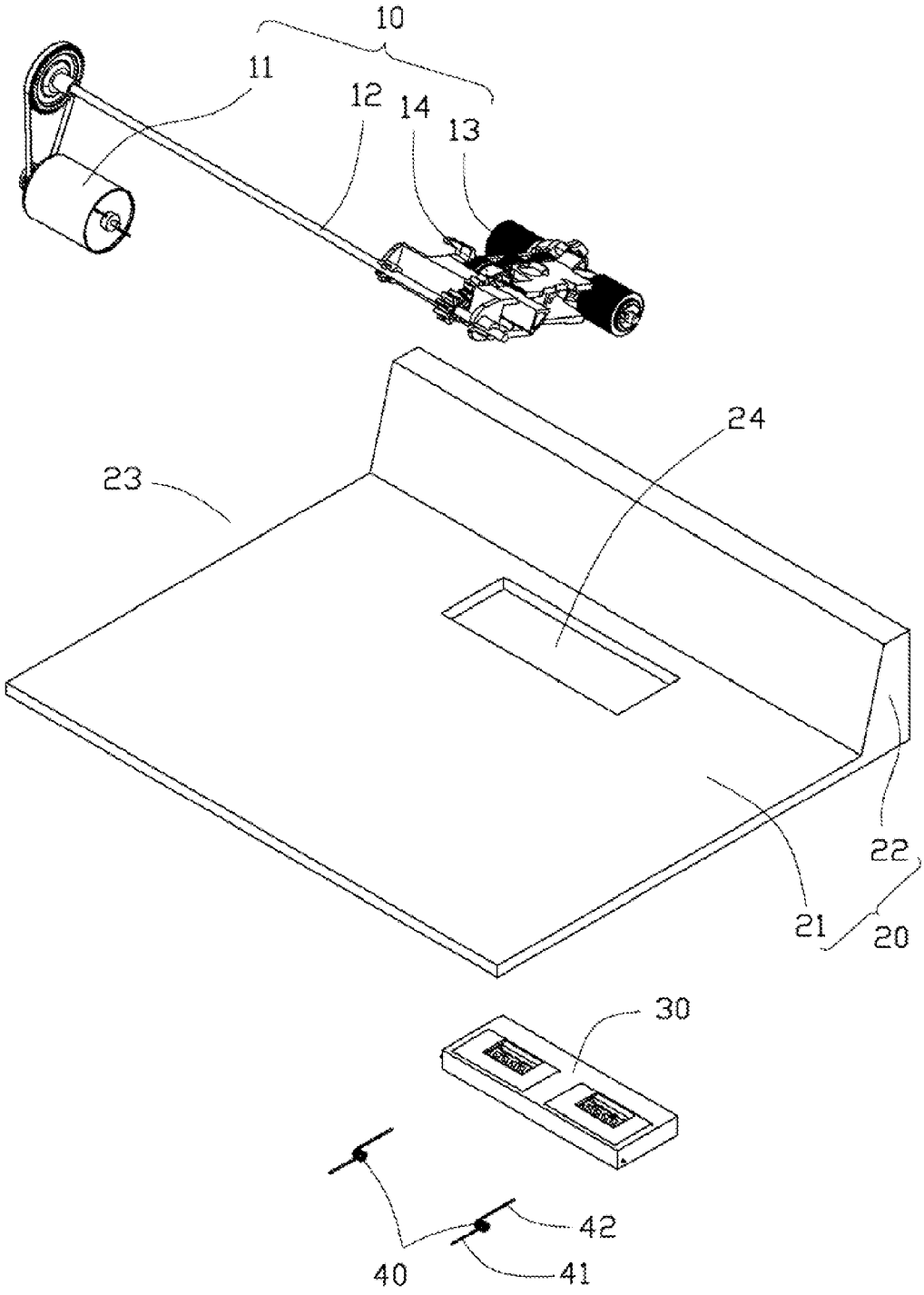
FIG. 2 is an exploded view of the sheet feeding apparatus of FIG. 1.
Figure 3:
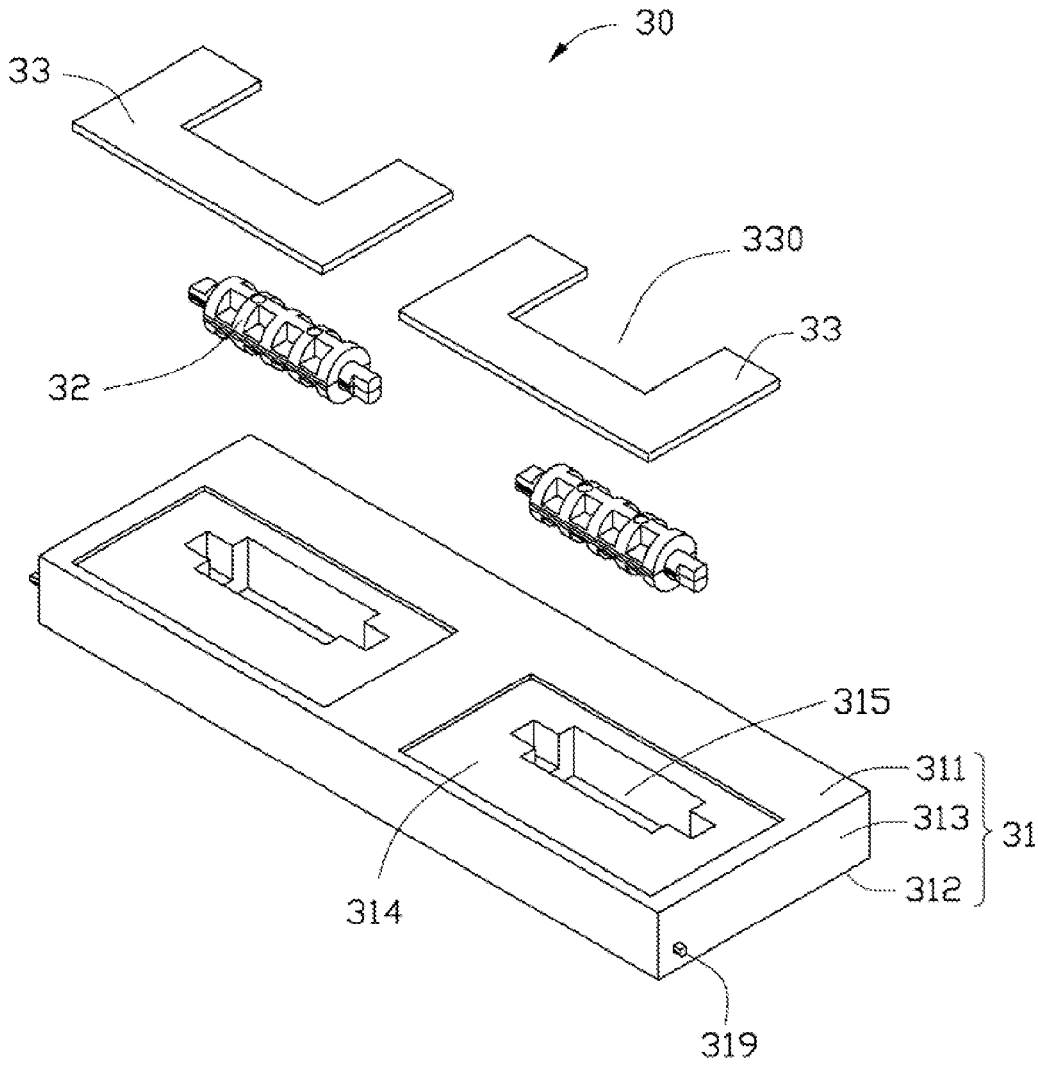
FIG. 3 is an exploded view of a separating mechanism of the sheet feeding apparatus of FIG. 1.
Figure 4:
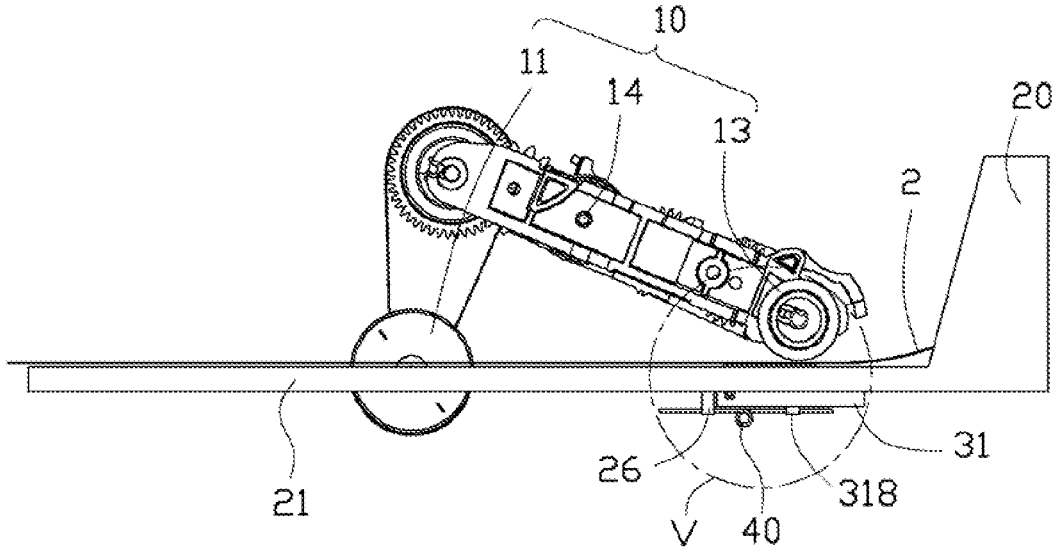
FIG. 4 is a side view of the sheet feeding apparatus of FIG. 1.
Figure 5:
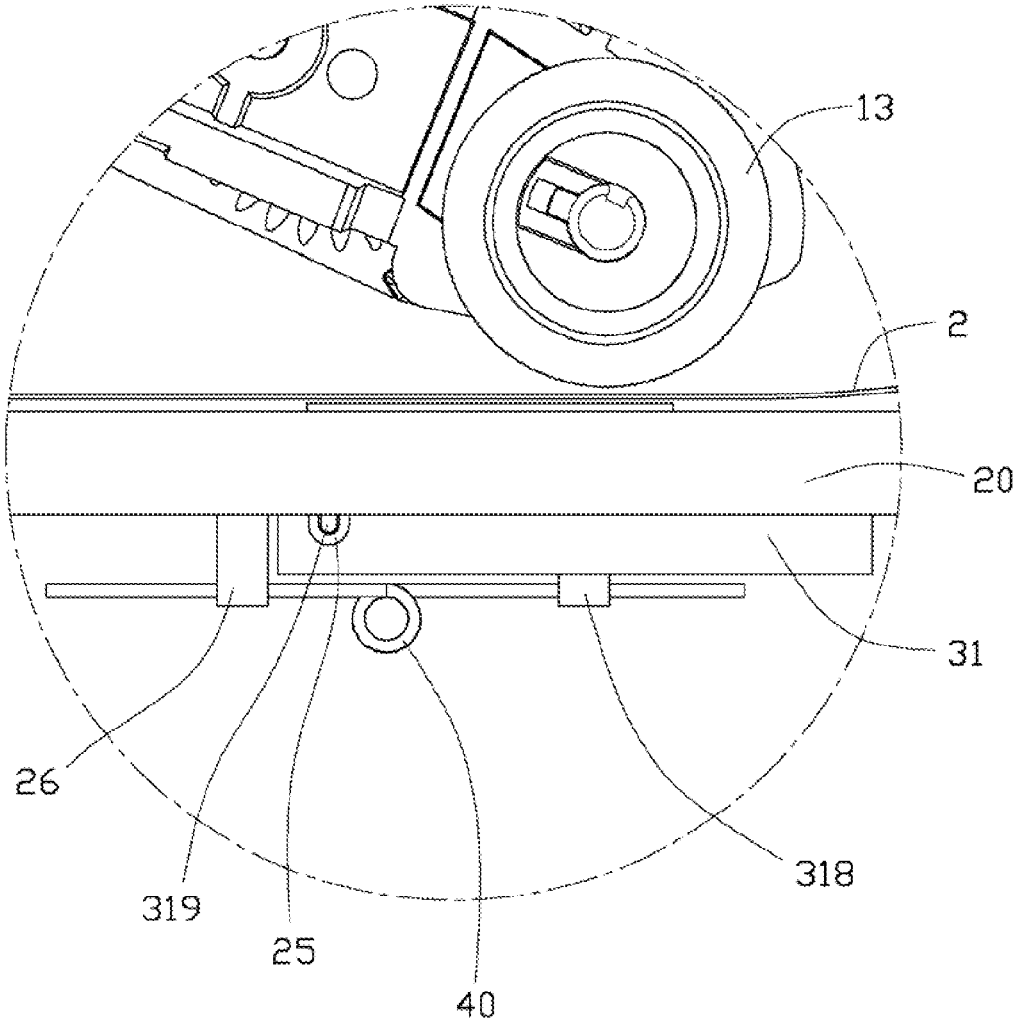
FIG. 5 is an enlarged view of a portion V of FIG. 4.

Referring to FIGS. 2, 3, and 5, the tray 20 includes a base plate 21 and a sidewall 22 protruding from the base plate 21, which cooperatively define a receiving space 23 for receiving the sheets 2. The base plate 21 defines a mounting hole 24 for receiving the separating mechanism 30.

The separating mechanism 30 includes a base board 31, two second rollers 32, and two retard pads 33. The base board 31 includes a top surface 311, a bottom surface 312, and two side surfaces 313. The top surface 311 defines two recesses 314. Each recess 314 defines a cavity 315. Each second roller 32 is rotatably retained within one cavity 315. The retard pad 33 is received in the recess 314 and defines an opening 330 allowing the second roller 32 to extend therethrough and make contact with the first rollers 13. Thus, the second rollers 32 can be rotated by the first rollers 13 to decrease the friction between the separating mechanism 30 and the sheet 2.

In the embodiment, the side surfaces 313 of the base board 31 each include a connecting rod 319 protruding therefrom. The tray 20 includes two rod receivers 25 on the bottom surface of the base plate 21 to rotatably receive the connecting rods 319. As a result, the separating mechanism 30 is rotatably connected to the tray 20.

Figure 6:
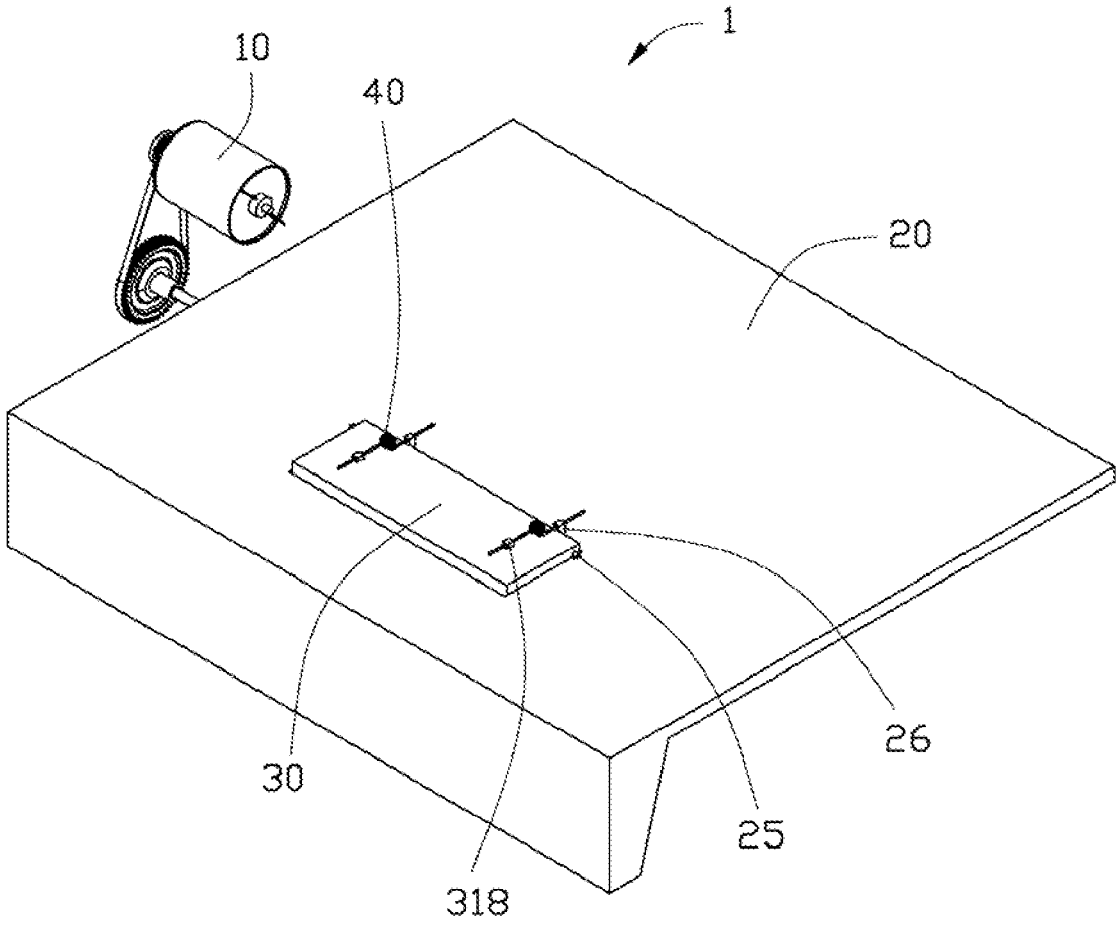
FIG. 6 is another isometric view of the sheet feeding apparatus of FIG. 1, but viewed from underneath.

Referring also to FIG. 6, each torsion spring 40 includes a first arm 41 and a second arm 42 respectively contacting the tray 20 and the base board 31, and pushes the baseboard 31 upwards so as to provide a constant pressure against the separation mechanism 30. In the embodiment, the tray 20 include two first blocks 26 which the first arm 41 of the torsion spring 40 abuts, and the base board 31 includes two second blocks 318 on the bottom surface 312 which the second arms 42 of the torsion spring 40 abuts.

Figure 7:
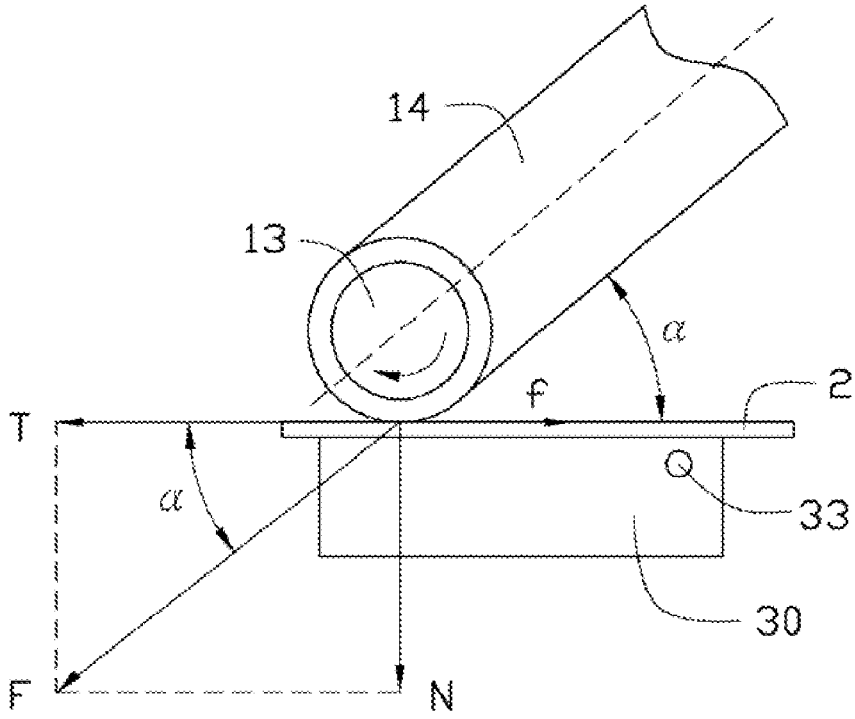
FIG. 7 is an illustration of the forces applied to sheets by the sheet feeding apparatus of FIG. 1.

Referring also to FIG. 7, when the motor 11 is working, the first roller 13 rotates and drags (by exerting torsion force F) the sheet 2 according to the direction of rotation parallel to the transmission mechanism 14. The torsion force F can be divided into a tangential component force T and a normal component force N. The force T overcomes the friction applied to the sheets 2 by the retard pad 33 of the separating mechanism 30. There exists a predetermined included angle $\alpha$ between the sheets 2 and the direction of the torsion force F. $T=F*\cos\alpha$; $N=F*\sin\alpha$; $f=N*\mu$, wherein $\mu$ is the constant frictional coefficient between the retard pad 33 and the sheet 2. The force N pushes the separating mechanism 30 to slightly rotate about the connecting rod 319 when the tray 20 has only a few sheets 2 left. The included angle $\alpha$ then decreases. Then the force T is increased simply by virtue of the geometrical arrangement, and the friction is decreased. Therefore, the resistance to the motor 11 which would otherwise be present is reduced.

While various embodiments have been described and illustrated, the disclosure is not to be constructed as being limited thereto. Various modifications can be made to the embodiments by those skilled in the art without departing from the true spirit and scope of the disclosure as defined by the appended claims.

What is claimed is:

1. A sheet feeding apparatus comprising:

a tray comprising a base plate defining a mounting hole extending therethrough and a sidewall protruding from the base plate, which cooperatively define a receiving space for holding a stack of paper sheets;

a driving assembly disposed above the tray, and comprising at least one roller to move a top one of the sheets;

a separating mechanism received in the mounting hole and rotatably connected to the tray for contacting a bottom of the stack of the sheets, and comprising a base board rotatably retained within the mounting hole and at least one retard pad to separate the sheets, wherein the base board comprises a top surface defining at least one recess for receiving the at least one retard pad; and at least one resilient element to provide a spring force to the separating mechanism such that the at least one retard pad creates frictional resistance between the separating mechanism and the stack of the sheets, wherein the separating mechanism is rotated and the frictional resistance is reduced when the tray has only a few sheets left.

2. The sheet feeding apparatus as described in claim 1, wherein the base board comprises two side surfaces and two connecting rods respectively protruding from one side surface, and the tray comprising two rod receiver on a bottom surface of the bottom plate to rotatably receive the connecting rods.

3. The sheet feeding apparatus as described in claim 1, wherein each of the at least one recess defines at least one cavity, and the separating mechanism further comprises at least one second roller rotatably retained within one of the at least one cavity.

4. The sheet feeding apparatus as described in claim 1, wherein the tray comprises at least one first block, the base board comprises a bottom surface and at least one second block protruding from the bottom surface, and the at least one resilient element is a torsion spring each comprising a first arm and a second arm respectively abutting against the tray and the base board.

* * * * *